United States Patent [19]

Brewerton

[11] Patent Number: 4,721,053

[45] Date of Patent: Jan. 26, 1988

[54] MOTION COMPENSATORS AND MOORING DEVICES

[76] Inventor: Robert W. Brewerton, 68 Betenson Avenue, Sevenoaks, Kent, England

[21] Appl. No.: 683,673

[22] Filed: Dec. 19, 1984

[30] Foreign Application Priority Data

Dec. 23, 1983 [GB] United Kingdom ..... 8334384

[51] Int. Cl.[4] ..... E21B 19/08

[52] U.S. Cl. ..... 114/230; 441/3; 441/4

[58] Field of Search ..... 114/264, 267, 230; 441/1, 2, 3, 4, 5, 21, 22, 28, 29; 188/318, 314, 315; 267/64.26, 64.25, 64.15, 64.11

[56] References Cited

U.S. PATENT DOCUMENTS

| | | | |
|---|---|---|---|
| 3,664,388 | 5/1972 | Frankel | 114/230 |
| 4,066,030 | 1/1978 | Milone | 114/230 |
| 4,086,865 | 5/1978 | Statham | 114/230 |
| 4,091,879 | 5/1978 | Andrepont | 188/314 |
| 4,305,341 | 12/1981 | Stafford | 114/230 |
| 4,371,037 | 2/1983 | Arnaudeau | 441/4 |
| 4,453,638 | 6/1984 | Wallace | 188/314 |
| 4,502,673 | 3/1985 | Clark | 188/314 |

FOREIGN PATENT DOCUMENTS

| | | | |
|---|---|---|---|
| 0045652 | 2/1982 | European Pat. Off. | 114/230 |
| 0071406 | 2/1983 | European Pat. Off. | 114/230 |
| 2408511 | 6/1979 | France | 114/230 |
| 5722797 | 7/1980 | Japan | 114/230 |
| 7312778 | 9/1973 | Netherlands | 114/230 |
| 7808618 | 8/1978 | Netherlands | 114/230 |
| 54186 | 4/1896 | Norway | 114/230 |
| 849887 | 9/1960 | United Kingdom | 114/230 |
| 1118049 | 6/1968 | United Kingdom | 114/230 |
| 1170566 | 11/1969 | United Kingdom | 114/230 |
| 1469669 | 4/1977 | United Kingdom | 114/230 |
| 1476673 | 6/1977 | United Kingdom | 114/230 |
| 1482604 | 8/1977 | United Kingdom | 114/230 |
| 2015692 | 9/1979 | United Kingdom | 114/230 |
| 2024766 | 1/1980 | United Kingdom | 114/230 |
| 1586130 | 3/1981 | United Kingdom | 114/230 |
| 2094738 | 9/1982 | United Kingdom | 114/230 |
| 313712 | 2/1813 | U.S.S.R. | 114/230 |
| 1105378 | 7/1984 | U.S.S.R. | 114/230 |

*Primary Examiner*—Jeffrey V. Nase
*Assistant Examiner*—Clifford T. Bartz
*Attorney, Agent, or Firm*—Cushman, Darby & Cushman

[57] ABSTRACT

A compensator for providing resilience in a connection between relatively moveable objects comprises a piston (3) working in a cylinder (2) which is surrounded by a larger coaxial cylinder (1) joined thereto by annular wall members (1*a*) thus defining about the cylinder (2) a pair of annular reservoirs (8,9). The piston (3) divides the cylinder (2) into a pair of chambers (6,7), chamber (6) being connected by conduit (12) to reservoir (9) and chamber (7) being connected by conduit (10) to reservoir (8). Each reservoir contains a mixture of liquid and gas while the chambers contain liquid. Elongation of the connection between the objects causes withdrawal of the piston (3) with consequent expansion of the volume of gas in reservoir (9) against atmospheric pressure and against pressure developed in reservoir (8) as a consequence of decrease of gas volume therein.

20 Claims, 9 Drawing Figures

MOTION COMPENSATORS AND MOORING DEVICES

FIELD OF THE INVENTION

The present invention relates to compensators to provide resilience in connections between relatively movable objects over a working range of distances between said objects in order to accomodate said relative movement and optionally to control the forces between them e.g. so as to provide a substantially constant force. It has particular, but not exclusive application to the control of tension in a load-bearing line, such as a cable joining a floating vessel to a sea-anchor, a cable used to transfer a load between a floating vessel and a fixed structure or in a flexible hose linking a floating vessel to a fixed installation or for the mooring of floating vessels in exposed locations by directly acting between a fixed anchor and the floating vessel.

BACKGROUND TO THE INVENTION

The control of tension in load bearing lines is required in many different circumstances. The desired nature of the control varies according to the circumstances. Often it is considered desirable for the tension to be progressively increased as the connection made by the line is elongated. Methods are presently available for producing such a pattern of control. For instance, a heavy catenary line provides progressively greater tension as it is stretched until it becomes bar-taught. Pneumatic spring devices are known which provide a similar increase in tension with increasing excursion. For instance, German specification No. 54186 discloses a device comprising a cylinder and a piston for mounting on a vessel connected to the anchor chain, the cylinder being in fluid connection with a reservoir. The cylinder and part of the reservoir contain liquid and the remainder of the reservoir contains a pressurised gas which is gradually further compressed upon the vessel moving away from its anchor. Such an arrangement provides increasing tension with excursion of the vessel from its mooring point.

Essentially similar devices are disclosed in Dutch patent specification No. 7312778, Dutch patent specification No. 7808618 and European patent application No. 0045652.

There are a variety of other circumstances however in which it is desirable to provide a different pattern of variation of tension in a line with varying degrees of excursion of the objects connected by the line. For instance, it has now been discovered that in deep sea anchorages the use of a rising rate type of tension device such as a heavy catenary line or a pneumatic device of the kind shown in German patent specification No. 54186 leads to undesirable results. In particular, the normal load in the line is excessive and is significantly above that actually required on average.

Moreover, the maximum load experienced in the line is very heavily dependent upon the maximum excursion experienced and a miscalculation of the excursion to be expected could lead to very much higher loads being experienced in the line than expected, with consequent difficulties such as parting of the line or dragging of anchors.

Furthermore, the use of conventional mooring systems provides other disadvantages such as the long distance to anchors necessary with multiple catenary moorings which imposes limitations on the disposition of the anchors having regard to sea bed obstructions such as sea bed equipment. In the case of the use of spring buoys as tension control devices in moorings, the amount of buoyancy required in the spring buoy to provide a strong enough spring is sometimes so large that major structures are required on the sea bed to take the additional uplift force generated by the buoyancy of the buoy and furthermore, providing the required buoyancy may entail large buoyant structures which themselves will, even when submerged, attract wave forces which will be additional to the forces imposed by the moored structure itself.

It is accordingly desirable to provide devices for controlling the tension in lines such as mooring lines which provide a different variation of tension with excursion than the systems described above or which avoid the use of large buoyant structures as a means of tension control.

In yet other circumstances, it is desirable to be able to alter the pattern of tension variation with excursion to fit the particular circumstances in which the equipment is being used.

British patent specification No. 849887 discloses an anchoring system in which excursion of a moored platform is controlled by lines connected to weights so that there is a constant force in the line despite excursion of the platform or in an alternative embodiment the lines are connected to pneumatic cylinders working against a constant pressure so that again there is constant tension in the lines. However, the apparatus described in specification No. 849887 is not adapted for use in other circumstances than the particular type of structure shown. In particular, it is not adapted for use at an intermediate position in a line connecting two relatively moveable objects.

SUMMARY OF THE INVENTION

The present invention provides compensators for use in controlling tension in lines between relatively moveable objects which operate on principles different from those described in the above specifications.

Accordingly, the present invention provides a method for providing resilience in a connection between a first object and a second relatively moveable object, comprising connecting between the first and second objects a compensator for accomodating relative movement between the objects which compensator comprises a pair of telescopically acting members such that telescopic movement of the members to elongate the connection is resisted by a restoring force produced by expanding a volume occupied by a gas so as reversibly to displace a fluid against pressure.

Preferably said fluid is a liquid.

Preferably the first object is below the surface of a body of water and the second object is at or near the surface of the water.

Preferably the compensator is in the water.

The object at or near the surface may be connected to the compensator by a flexible conduit for the transfer of fluid.

The compensator may comprise means defining an at least substantially submerged vessel containing a gas which vessel comprises a cylinder and a piston movable therealong in sealing relationship therewith, the volume of which vessel being increased by lengthening of said connection acting to move said piston in said cylinder, the piston being exposed to pressure from said body of water to tend to decrease said vessel volume, the arrangement being such that a force urging a change in the relative positions of the piston and cylinder is at least partially resisted by force exerted on the piston by the water.

The piston may be connected to one of said objects and the cylinder may be connected to the other.

The compensator may comprise means defining a vessel containing a gas which vessel comprises a cylinder and a piston movable therealong in sealing relationship therewith, the volume of which vessel is increased by lengthening of said connection acting to move said piston in said cylinder, and said cylinder and said piston defining a chamber containing a liquid, and the compensator comprising a reservoir containing a gas having an interface with a liquid also contained in the reservoir, and means defining a flow path interconnecting the said chamber and reservoir for liquid flow therethrough in response to changes in the volume of the chamber, the combined volume of liquid in said chamber, conduit and reservoir being substantially constant.

The reservoir preferably surrounds at least a portion of the cylinder.

The vessel may be closed.

The reservoir may contain a substantially constant mass of gas.

The piston may divide the cylinder into a first chamber and a second chamber of mutually inversely varying volumes and the second chamber may be connected by a flow path to an otherwise closed second reservoir for fluid flow therebetween.

The second reservoir may contain a constant mass of gas having an interface with liquid also contained therein, the volume of liquid in said second chamber, second reservoir and flow path therebetween may be substantially constant.

The second chamber may contain a constant mass of gas.

The compensator may comprise a cylinder attached to one of the two relatively movable objects, a piston attached to the other of said objects and slidably received in said cylinder to divide it in fluid-tight manner into first and second chambers of mutually inversely varying volumes, said first chamber increasing in volume as the piston and cylinder are moved apart and containing liquid, said second chamber containing a liquid;

a first reservoir of constant volume and containing, in operation, a constant mass of gas having an interface with a liquid also contained in the said reservoir;

means defining a first flow path interconnecting the first chamber and reservoir for liquid flow therebetween:

the combined volume of liquid in said first chamber, reservoir and flow path being substantially constant;

a second reservoir of constant volume and containing, in operation, a constant mass of gas having an interface with a liquid also contained in said second reservoir; and means defining a second flow path interconnecting the second chamber and the second reservoir for liquid flow therebetween;

the combined volume of liquid in said second chamber, second reservoir and second flow path being substantially constant;

the arrangement being such that the changes in tensile force urging the piston and cylinder apart are at least partially compensated by force exerted on the piston by fluid in the respective chambers.

The compensator may comprise:

a cylinder attached to one of the two relatively movable objects, a piston attached to the other of said objects and slidably received in said cylinder to divide it in fluid-tight manner into first and second chambers of mutually inversely varying volumes;

a first chamber increasing in volume as the piston and cylinder are moved apart and containing air, said second chamber containing water, a reservoir containing a mass of air in communication with said first chamber;

means defining a flow path for water to the second chamber, the arrangement being such that changes in tensile force urging the piston and cylinder apart are at least partially compensated by force exerted on the piston by the water.

The mass of air in the reservoir may be constant.

For many uses it is preferred that the compensator by buoyant in water.

For use under water the compensator is preferably provided with means to pump out water that has pressed into the cylinder, said means preferably being operated by movement of the piston in the cylinder.

The invention includes a method for providing resilience in a connection between an object below the surface of a body of water and an object at or near the surface comprising connecting between said objects a compensator comprising a pair of mutually slideable members wherein one of said members is buoyant and the other is heavy and the compensator is connected between said objects with the buoyant one of said members lowermost.

The members may be a piston and a cylinder, the piston being slideable along said cylinder.

The compensator may be such that the restoring force is constant or increases with elongation of the connection at a rate less than in proportion to the elongation of the connection.

The invention includes a compensator for accomodating relative movement between objects connected via the compensator which compensator comprises a pair of telescopically acting members such that telescopic movement of the members to elongate the connection is resisted by a restoring force produced by expanding a volume occupied by a gas so as reversibly to displace a fluid against pressure.

Preferred features of the compensator are set out above.

A particularly preferred compensator comprises means defining a vessel containing a gas which vessel comprises a cylinder and a piston movable therealong in sealing relationship therewith, the volume of which vessel being increased by lengthening of said connection acting to move said piston in said cylinder, said cylinder and said piston defining a chamber containing a liquid, and the compensator comprising a reservoir containing a gas having an interface with a liquid also contained in the reservoir, and means defining a flow path interconnecting the said chamber and reservoir for liquid flow therethrough in response to changes in the volume of the chamber, the combined volume of liquid in said chamber, flow path and reservoir being substantially constant.

The reservoir may contain a constant mass of gas, usually air, having an interface with liquid, usually water, also contained in the reservoir. Usually, the reservoir will be fluid-tight except for the connection with the first chamber. However, at certain times, in certain applications, the reservoir can be vented to ambient fluid surroundings, for example to see when the device is used at a substantial depth, e.g., 30 meters or more. In such instances, the load in the load bearing line will be dictated solely by the weight, buoyancies and inclinations of the piston, chamber and reservoir. Preferably, the reservoir surrounds the chamber and is of larger volume than the chamber. The gas pressure in the reservoir determines the force exerted on the piston by fluid in the chamber and hence influences the force maintained by the device. Conveniently, gas and/or liquid supply conduits are provided to adjust the mass of gas and/or liquid in the reservoir chamber and interconnecting flow path in order to vary the energy stored in the device.

Advantageously, the cylinder constitutes part of a main body of the device with the piston slidable relative thereto although for some applications it may be preferred to have the piston fixedly attached to the main body and the cylinder slidable relative thereto. Usually, the cylinder will be provided with locating means, such as an eye, for attachment to a line from the respective one of the pair of relatively movable objects or, in certain instances, directly to said object. The piston will be attached, in operation, directly or indirectly by, for example a line to the other of said objects.

Preferably, a head of the piston sealingly engages the circumferential wall of the cylinder to form an at least substantially fluid-tight seal which is maintained upon relative movement between the piston and the cylinder to facilitate connection of the piston to the said other of the said relatively movable objects. Conveniently, the distal end of the piston is provided with locating means, such as an eye, for attachment to a line to said other object or, in certain cases, directly to that object. The piston can be slidably received within the cylinder or can be slidably received on the cylinder, in which latter case the piston will be hollow to receive the cylinder.

The flow of liquid through the flow path can be unthrottled or, if damping is required, throttled. A valve can be provided to control the rate of flow of liquid through the flow path. When the chamber and reservoir have a common wall, the interconnecting flow path can be merely an opening in that wall.

Preferably, the chamber also contains a constant mass of gas, usually air, to protect the device against shock and blockage of the flow path. Usually, the mass of gas in the reservoir will be greater than the mass of any gas in the chamber.

In a preferred embodiment, the piston divides the device into the first chamber and a second chamber of mutually inversely proportional volumes. The second chamber will contain fluid which can be liquid, usually water and/or gas, usually air. The second chamber usually will be connected by a conduit to a "second" reservoir for fluid flow therebetween but, when the fluid is that of the ambient surroundings, can be vented to said surroundings. Conveniently, the second reservoir is fluid-tight except for the fluid conduit to the second chamber. Advantageously, the second reservoir is of greater volume than the second chamber.

Depending upon the design of the device the pressure in the second chamber can be substantially above or below the pressure in the first chamber.

When the second chamber contains liquid, a conduit or other flow path usually will be connected to that chamber to allow changes in liquid volume therein in response to movement of the piston. This conduit can be the conduit connecting the second chamber to the second reservoir, when present.

Preferably, the second reservoir contains a constant mass of gas having an interface with liquid also contained therein, the conduit interconnecting the reservoir and the second chamber allows liquid flow therebetween, and the volume of liquid in said chamber, reservoir and conduit is substantially constant.

Advantageously, the second chamber also contains a constant mass of gas, usually air, to protect the device against shock and blockage of the conduit. Usually, the mass of gas in the second reservoir will be greater than the mass of any gas in the second chamber.

Optionally, the compensator is of variable buoyancy and comprises means for varying the buoyancy thereof between a state in which the compensator is buoyant in water and a state in which the compensator has negative buoyancy.

The invention includes a compensator for providing resilience in a connection between an object below the surface of a body of water and an object at or near the surface comprising a pair of mutually slideable members wherein one of said members is buoyant and the other is heavy and the compensator is adapted to be connected between said objects with the buoyant one of said members lowermost.

Preferably the members are a piston and a cylinder, the piston being slideable along said cylinder.

The invention includes a method for accomodating relative movement between two connected relatively movable objects which method comprises providing in the connection a compensator as described above.

The invention includes a method of mooring a vessel for transfer of fluid to or from the vessel comprising mooring the vessel by a hose also used for said fluid transfer. Preferably, the mooring hose extends between the vessel and a motion compensator as described herein.

The invention includes a method of mooring a vessel for transfer of fluid to or from the vessel comprising mooring the vessel by a line incorporating a motion compensator as described herein and transferring said fluid through a hose extending between the vessel and said mooring.

The invention also includes apparatus for mooring a vessel, which mooring apparatus includes a variable buoyancy buoy to which the vessel is to be moored when the buoy is in a buoyant condition and means actuable to sink the buoy to shield the buoy from damage e.g. waves, ice and other vessels. Preferably, the buoy includes a motion compensator as described herein.

BRIEF DESCRIPTION OF THE DRAWINGS

The following is a description by way of example only and with reference to the accompanying drawings, of embodiments of the present invention. In the drawings.

DESCRIPTION OF PREFERRED EMBODIMENTS

Figure 1:
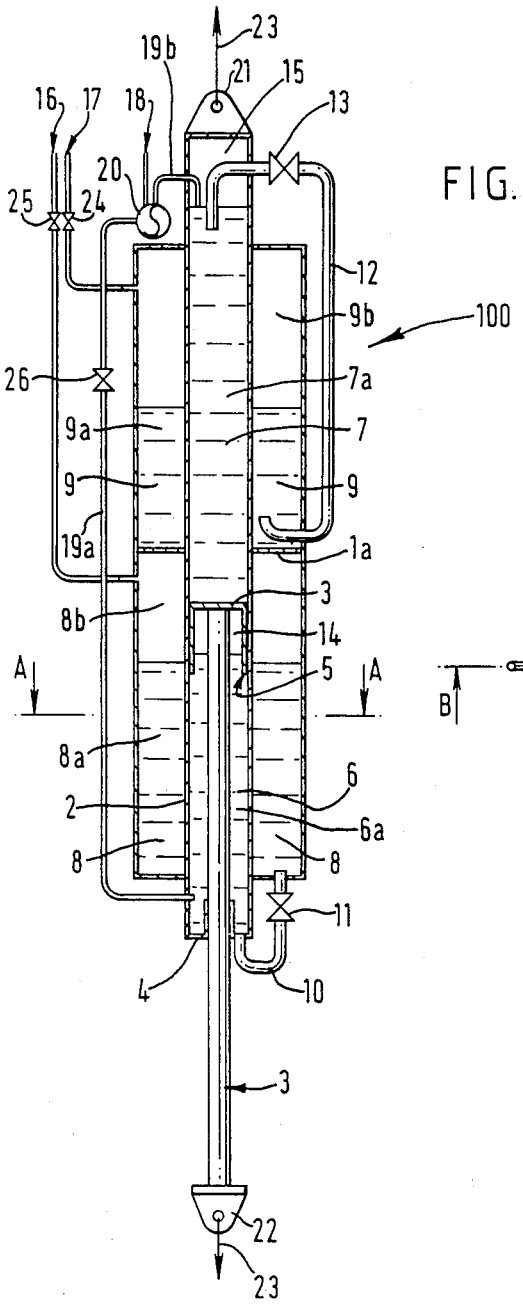
FIG. 1 is a diagrammatic longitudinal cross-section through a tensioning device in accordance with a first embodiment of the invention.
Figure 2:
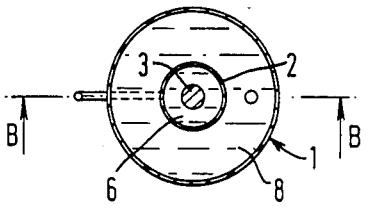
FIG. 2 is a view on the section AA of Figure

Referring to FIGS. 1 and 2, a device generally indicated at 100 comprises a coaxial pair of right circular cylinders 1,2. The inner cylinder 2 is closed at its upper end and has at that end an upwardly extending attachment eye 21. A piston 3 is slidably received in the cylinder 2 from its lower end through a fluid-tight seal 4 and has at its head a seal 5 which divides the cylinder 2 in fluid-tight manner into a lower (i.e. "second") chamber 6 and an upper (i.e. "first") chamber 7. Said chambers 6,7 each contain a mass of gas, usually air, 14,15 respectively above a volume of liquid, usually water *6a, 7a* respectively. The gas masses 14,15 can be omitted but are preferred in order to protect the device against shock and blockage of liquid flow conduits described above.

The outer cylinder 1 is closed at both ends and is divided into a lower (i.e. "second") reservoir 8 and an upper (i.e. "first") reservoir 9 by a fixed annular dividing wall 1*a*. Each reservoir 8,9 contains a mass of gas, usually air, *8b, 9b,* respectively above a volume of liquid, usually water, *8a, 9a* respectively.

Conduits 10,12 having respective valves 11,13 connect the liquid *6a, 7a* in the chambers 6,7 to the liquid *8a, 9a* in the respective surrounding reservoir 8,9. The mass of gas in reservoirs 8,9 can be adjusted by supply or removal of gas through air supply conduits 16,17 controlled by valves 24,25 respectively. The mass of fluid in the reservoirs 8,9 and in the chambers 6,7 can be adjusted by supply or removal of fluid via fluid supply conduit 18, pump 20 and branch conduits 19*a* and 19*b*. This fluid conduit system is controlled by the pump 20 and a valve 26 in the branch conduit 19*a* and can also be used to transfer liquid between the chambers 6,7 and, if required, to adjust the mass of gas 14,15 in said chambers 6,7.

In use, the device 100 is pretensioned by supply or removal of liquid and air to the chambers 6,7 and reservoirs 8,9 with the valves 11,13 open to permit fluid flow between the respective chambers and reservoir pairs. A line 23 is attached to eye 21 of the inner cylinder 2 and to an eye 22 protruding downwardly from the lower end of the piston 3. The line 23 is subsequently attached between two relatively movable objects, whence it is tensioned. Within the working range of the device 100 the tension in the line rises only relatively gradually upon movement of the piston 3. Said movement causes liquid to flow between each chamber 6,7 and its respective reservoir 8,9 through conduits 10, 12 to vary the volumes of the respective gas masses 14, 15 which masses remain constant throughout operation. If the valves 11,13 are open, the liquid flow will be substantially unhindered and hence the spring stiffness of the device at a minimun. However, if increased resistance to relative motion of piston and cylinder is required, the valves 11,13 can be partially closed, or even fully closed, to throttle or even stop, the liquid flow. Said valve adjustmet introduces viscous damping into the system by creating a flow-rate dependent pressure difference between the chambers and the reservoirs.

Usually the pressure in chamber 6 and reservoir 8 will be considerably greater than atmospheric pressure whilst that in chamber 7 and reservoir 9 will be just above atmospheric pressure (e.g. 0 to 2 bars). For underwater use of the device, the pressure in the chambers 7 and 9 may be less than the external ambient pressure.

A spray attachment (not shown) can be provided in reservoirs 8,9 and operated by liquid flow through the respective conduits 10,12 to cool the air masses *8b, 9b.*

The manner in which the tension varies with excursion of the connected objects can be varied by the gas pressures set and the relative gas volumes.

Figure 3:
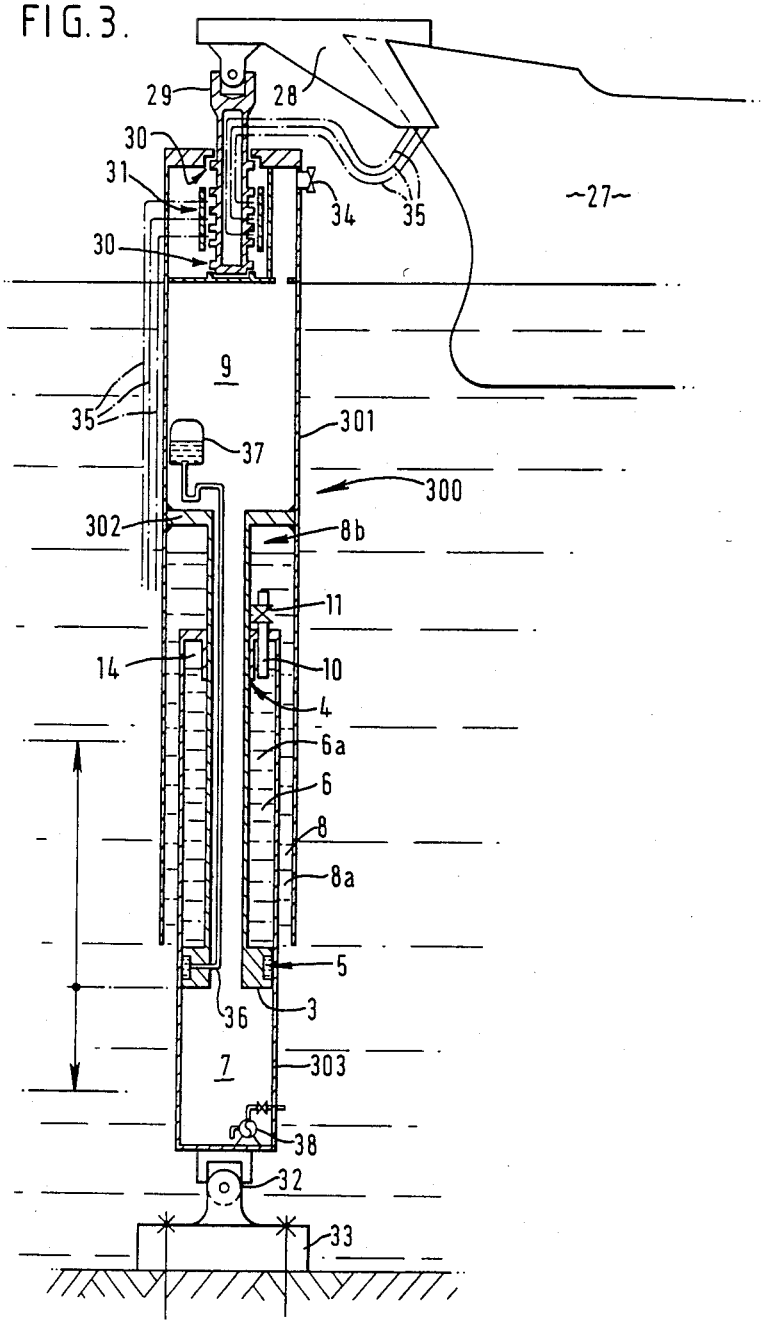
FIG. 3 is a diagrammatic longitudinal cross-section through a mooring device in accordance with a second embodiment of the invention.

Referring now to FIG. 3, a mooring device is generally indicated at 300 and comprises a right circular cylindrical body 301 having at the upper end thereof a universal joint 29 mounted on a swivel 30. An annular wall 302 divides the body 301 into an upper (or "first") reservoir 9 and a lower reservoir 8. A hollow piston 3 depends from said annular wall and is provided at its base with an annularly extending seal 5 forming a sliding fluid-tight fit in a right circular cylinder 303. The seal is maintained by viscous oil supplied under pressure to a circumferential groove in the seal 5 via pipe 36 from an oil reservoir 37. A seal 4 is provided at the top of the piston 3. The cylinder 303 is closed at its bottom end and has a universal joint 32 protruding downwardly therefrom. The upper end of the cylinder 303 is a sliding and fluid-tight fit about the shank of the hollow piston 3.

The volume in the cylinder 303 below the piston 3 constitutes the "first" chamber 7 of the device and the annular volume between piston 3 and the upper end of the cylinder 303 constitutes the "second" chamber 6. The "second" reservoir 8 is the volume between the upper end of the cylinder 303 and the annular wall 302 together with the volume between said cylinder and the circumferential wall of body 301. It will be appreciated therefore that reservoir 8 is of variable volume dependent upon the relative positions of the body 301 and cylinder 303 and that it is open at its lower end.

A conduit 10 having a valve 11 protrudes through the upper end wall of the cylinder 303 to permit liquid flow between chamber 6 and reservoir 8. Said chamber 6 and reservoir 8 both contain a constant mass of gas 14, *8b* respectively above a volume of liquid *6a, 8a* respectively and the conduit 10 is of such length as to only communicate between the respective liquid phases.

The chamber 7 and reservoir 9 are vented to atmosphere by an air vent 34 in the upper end of the body 301.

The compensator extends from the surface to the bottom of the water e.g. for 100 meters. Accordingly, the water pressure exerted on the top of the piston 3 may be considerably in excess of the atmospheric air pressure within second chamber 7.

In use, joint 32 is secured to a base 33 piled into a sea bed and the joint 29 is secured to a bow extension 28 of a ship or other vessel 27. If desired oil lines 35 can be attached to the body 301 via a rotatable connector 31 to extend betwen the sea bed and the vessel 27. With valve 11 open, water is free to flow between chamber 6 and reservoir 8 in response to movement of the body 301 with the vessel 27 whereby the mooring device provides a straight anchor of substantially constant tension and little or no stiffness. Damping can be provided by varying the flow rate thorugh conduit 10 by adjustment of valve 11.

A pump 38 is provided within the chamber 7, to pump out any water which passes seal 5.

The vessel 27 can be provided with production and storage facilities thereby providing in its moored state a floating production vessel which can be used to exploit marginal fields or fields which for other reasons, such as political instability or sea-bed structure, are considered unsuitable for fixed production facilities.

The device shown provides constant tension despite movement of the moored vessel, thus preventing excessive loads being developed.

Figure 4:
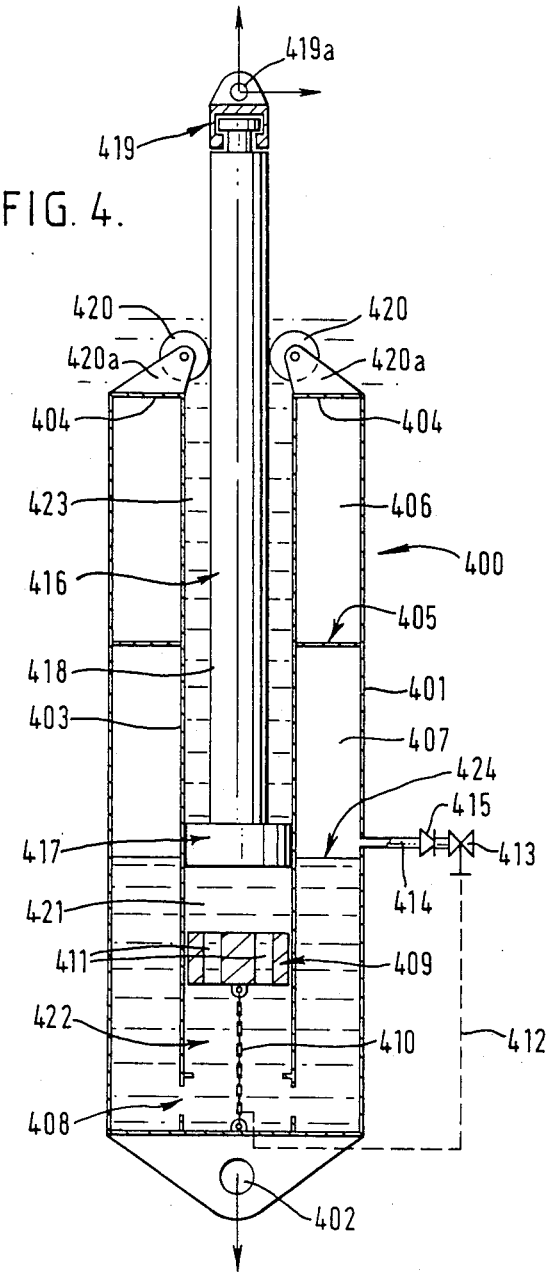
FIG. 4 is a diagrammatic longitudinal cross-section through a mooring device in accordance with a third embodiment.

Referring now to FIG. 4, a mooring device is generally indicated at 400 and comprises a right circular outer cylinder 401 closed at its base and having an attachment eye 402 depending therefrom. An inner circular cylinder 403 extends coaxially from the base of the outer cylinder 401 to the level of the top of said cylinder. The annular space defined between the inner and outer cylinders 401,403 is closed at its upper end by an annular top wall 404. An annular bulkhead 405 extends between the inner and outer cylinder 401, 403 to divide the annular space into upper and lower chambers 406, 407 respectively. The upper chamber 406 is fluid-tight and filled with air to act as a buoyancy chamber. Openings 408 in the wall of the inner cylinder 403 are provided towards the bottom thereof to permit fluid flow from chamber 407 into the inner cylinder 403.

A float 409 is secured by a chain 410 to the base of the outer cylinder 401. This float 409 is located within the inner cylinder 403 and is spaced from the wall thereof by a small gap. Bores 411 extend vertically through the float to permit fluid flow therethrough. A logic system schematically represented by broken line 412 senses slackening of the chain 410 and operates to close a valve 413 controlling fluid flow through a pipe 414 extending from the lower chamber 407. A non-return valve 415 is also provided in said pipe at a position between valve 413 and the chamber 407 to permit outflow from chamber 407.

A piston 416 is slidably received in the inner cylinder 403 with a head 417 sealingly engaging the cylinder wall. The piston has a rod 418 which extends upwardly from the cylinder 403 and terminates in a swivel joint 419 carrying an attachment eye **419*a*. Piston guides e.g. wheels 420 are mounted on brackets 420*a* extending from the top wall 404 to engage and guide the piston rod 418**.

The part 421 of the inner cylinder 403 between the piston head 417 and the float 411 can be said to constitute the first chamber of the device with the part 422 of the inner cylinder 403 below the float 411 constituting with the lower chamber 307 the first reservoir. The bores 411 and annular gap between the float 411 and inner cylinder 403 constitute the flow path interconnecting the first chamber and the first reservoir. The annular part 423 of the cylinder 403 around the piston rod 418 constitutes the second chamber which is open at its upper end.

The chamber 407 contains water or other liquid and air or other gas with a gas-liquid interface 424 and the part of the inner cylinder 403 below the piston head 417 is filled with the liquid. The pressure of gas in chamber 407 determines the force exerted in the piston by the liquid column in the cylinder. In use, the eye 402 is secured by, for example, a line or a universal joint to a foundation on the sea bed and the eye 419 is secured by for example, a line or a buoy riser to a ship or other vessel. The gas pressure in chamber 407 is adjusted in the absence of load until the piston (which is of negative buoyancy) rests upon the float 411 with the chain 410 substantially taut. Any excess liquid in the chamber 407 will be discharged via pipe 414. When the piston 416 is pulled from the cylinder 403, the resultant upward movement of the piston will cause liquid to flow into the first chamber 421 because of the increased volume of that chamber. The volume of gas in chamber 407 will thereby increase reducing the pressure thereof because the mass of gas is constant.

The upward movement of the piston will prevent the build-up of large forces in the connection between the piston and the object tethered, e.g. a vessel. The tension in the connection will be progressively increased however due to the falling gas pressure in chamber 407.

The second chamber 423 is open to the sea and hence filled with sea water at constant pressure dependent upon the operating depth but substantially independent of the position of the piston 416.

By virtue of its negative buoyancy, the piston 418 may be used to pump out any water which may have leaked past the piston head 417 or valve 15 during usage. The negative buoyancy can also be utilised to adjust the mass of gas and liquid in chamber 407 during initial setting of the system by overfilling chamber 407 with gas and leaving valve 413 open.

Figure 5:
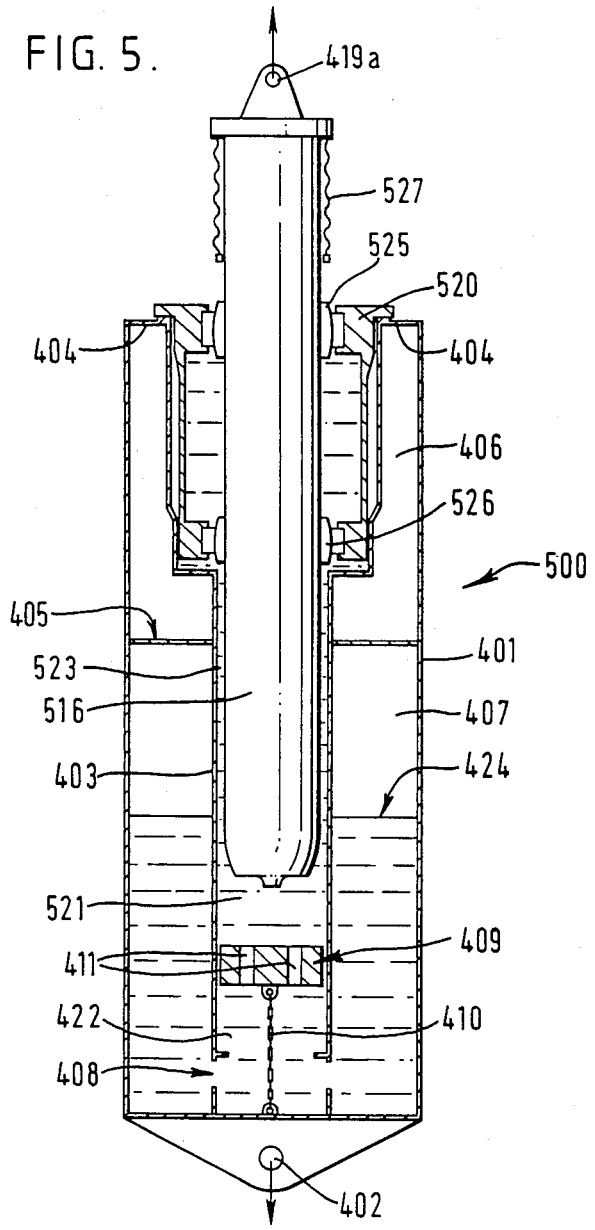
FIG. 5 is a diagrammatic longitudinal cross-section through a mooring device in accordance with a fourth embodiment.

Referring to FIG. 5, a mooring device is generally indicated at 500 and is of a construction similar to that of the device 400 of FIG. 4. Components of the device 500 which have counterparts in the device 400 have been identified by the same reference numerals as those used in FIG. 4. The piston 516 of the device 500 does not have an enlarged head but a fluid-tight seal with the inner cylinder 403 is provided by spherical plain bearings 525,526 mounted on a carrier 520 provided in an enlarged upper portion of the inner cylinder 403. The carrier is fixed in fluid-tight manner in the cylinder 403 so that the "first" chamber of the device 500 is constituted by the space 521 between the piston 516 and the float 409 in combination with the annular space 523 between the piston 516 and the inner cylinder below the lower bearing 526. A flexible sleeve 527 is provided around the upper end of the piston 516 to prevent marine life and other deposits on the piston which could damage the bearing 525 or hinder relative movement between the piston 516 and the cylinder 401.

The device 500 operates in substantially the same manner as device 400.

Figure 6:
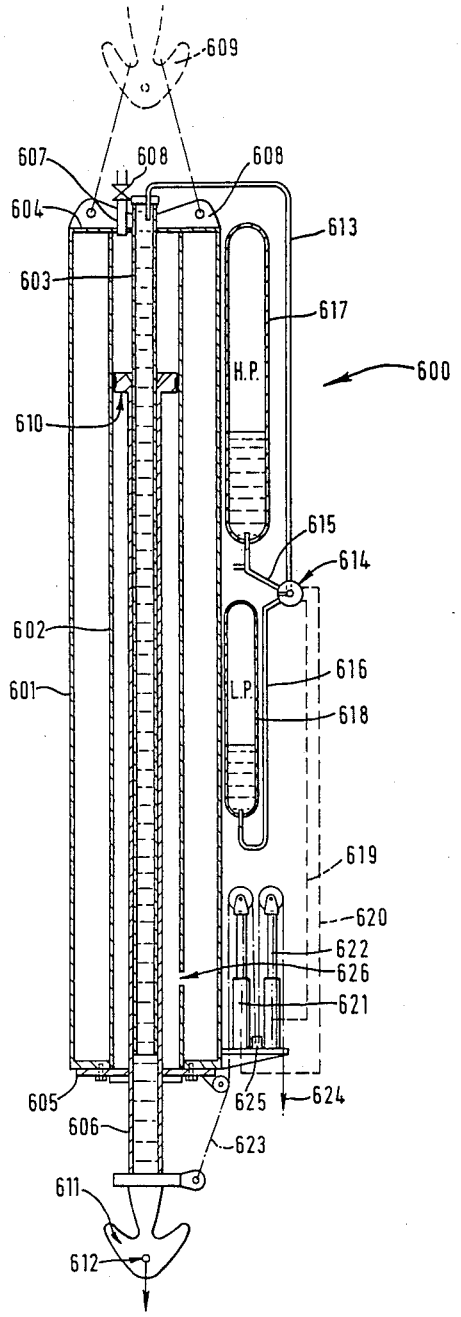
FIG. 6 is a diagrammatic longitudinal cross-section through a lifting device in accordance with a fifth embodiment.

Referring now to FIG. 6, a compensator for use in transferring loads to and from a moving vessel is generally indicated at 600. The compensator 600 comprises a right circular outer cylinder 601, a coaxial circular intermediate cylinder 602, and a coaxial circular inner cylinder 603. The outer and intermediate cylinders 601, 602 are of the same length and are closed at their top by an annular top wall 604 extending in fluid-tight manner around the inner cylinder 603 which extends upwardly therefrom. The bottom of the outer and intermediate cylinders is closed by an annular base wall 605 having a seal around its inner periphery which slidably receives a movable piston 606. A lug 608 extends upwardly from the top wall 604 and has eyes permitting the attachment thereto of chains or ropes suspended from a crane hook 609.

The piston 606 is hollow and is slidably received on the inner cylinder 603 being sealed thereto in fluid tight manner at a piston head 610. The piston head 610 also seals against the intermediate cylinder 602 in a fluid-tight manner. A hook 611 is provided at the bottom of the piston and has an eye 612 for attachment of a line thereto.

The inner cylinder 603 is closed at its upper end except for a pipe 613 and is open at its lower end which is spaced slightly above the level of the base wall 605. The pipe 613 terminates in a hydraulic control valve 614 which is operable to selectively connect the pipe 613 to outlet pipes 615, 616 from a high pressure reservoir 617 and a low pressure reservoir 618 respectively. Both reservoirs contain a constant mass of gas and a quantity of liquid. The valve 614 is controlled by differential air pressure passing along air lines 619, 620 from control cylinders 622, 621 respectively. The pressures in the cylinders 621, 622 are controlled by respective pistons the positions of which are controlled by respective control lines 623, 624. Line 623 passes from an attachment eye on the hook 611 over a pulley mounted on the piston of cylinder 621 and is secured to a bracket 625 upon which cylinders are mounted. The bracket 625 is secured to the outer cylinder 601. The control line 624 is also attached to the bracket 625 and extends over a pulley mounted on the piston of cylinder 622 to terminate in a control handle (not shown).

The outer and intermediate cylinders 601, 602 are interconnected by an opening 626 in the wall of the intermediate cylinder 602.

The outer cylinder 601 and the intermediate cylinder 602 below the piston head 610 contain air at a pressure of, for example, 35 bars. The space above the piston head 610 is vented to atmosphere by means of a venting pipe 607 which can include a throttling valve 628 to provide for damping. The inner cylinder 603 and piston 606 contain a hydraulic fluid which also fills pipes 613, 615 and 616. The control arrangement for valve 614 is such that when the pistons in cylinders 621, 622 are at the same height, the valve is closed. When the piston in cylinder 622 is above that in cylinder 621, the valve 614 connects pipe 616 to pipe 613 but when the piston in cylinder 621 is above that in cylinder 622 the valve 614 connects pipe 615 to pipe 613. Initially, the valve 614 is operated to connect pipes 613 and 615 whereby the fluid is under the pressure exerted by gas in the reservoir 617. This pressure is selected to balance the air pressure in cylinders 601, 602 so that the piston 606 is maintained at the top of its stroke.

In this condition, forces acting to move the piston 606 downwardly from the outer cylinder 601 are accommodated by movement of the piston producing corresponding reduction in pressure within the inner cylinder 603 and piston 606 because of increase in the volume of the constant mass of gas in the high pressure reservoir 617. The volume of gas in the annulus between chambers 601 and 602 and in chamber 602 below the piston head 610 is reduced thereby increasing the pressure in those spaces and hence contributes to the spring stiffness of the system. The inner cylinder and hollow piston constitute the "first" chamber of the device whilst the space in intermediate cylinder 603 below the piston head 610 constitutes the "second" chamber.

When it is desired to lift a load from, for example, the deck of a ship by a crane mounted on an offshore platform, a line, preferably an elastic line, is secured to the eye 612 and the crane hook 609 lowered to allow the line to be attached to the load. With the control line 624 taut, the piston 606 will move up and down with the ship whilst maintaining substantially a constant small force on the crane hook 609. This facilitates attachment of stings or other means retaining the load to the piston hook 611.

If after releasing an amount of control line from the ship, it is secured relative to the ship, the load will rise relative to the ship until such time as the piston in cylinder 621 becomes level with the piston in cylinder 622. At this time the load will be stationary relative to the crane hook 609. Subsequent movement of the ship and attached control line relative to the hook 609 will cause valve 614 to operate in such manner as to maintain the difference in level between the pistons of cylinders 621, 622 at a minimum whereby the relative vertical distance between the load and the ship is maintained substantially constant for as long as the control line is attached to the ship.

When the control line is gradually released, the piston of cylinder 622 will rise to a greater height than that of cylinder 621 and hence the valve 614 will connect line 616 to line 613. Connection of lines 616 and 613 will reduce the pressure in the inner cylinder 603 and hollow piston 606 and thereby allow piston 606 to rise in response to the air pressure in the outer and intermediate cylinders 601, 602. The load will thereby be raised from the deck to be freely suspended from the crane hook 609 whence it can be hoisted onto the platform.

The device 600 can be operated in similar manner to lower a load into the deck of a ship.

It can be seen that by the provision of a choice of gas reservoirs to be connected to the first chamber, a choice of preload is available. Where the reservoirs are of difference volumes, a choice of spring rate is also provided.

Figure 7:
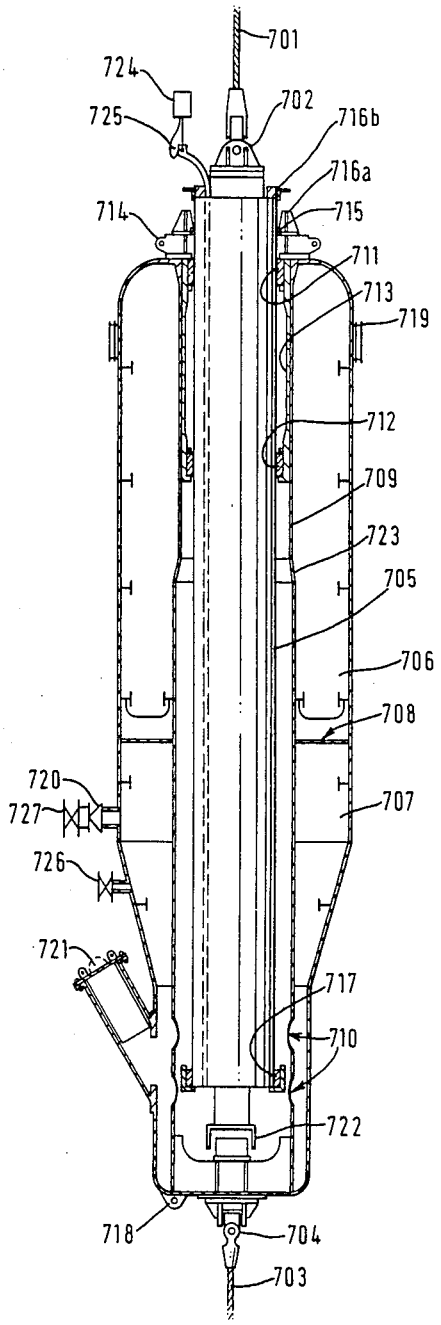
FIG. 7 is a diagrammatic longitudinal cross-section through a mooring device in accordance with a sixth embodiment.

Referring now to FIG. 7, the device consists of a heavy headless cylindrical piston 705 which runs inside a cylinder 709 contained in a cylindrical housing which is divided into two parts by a dividing diaphragm 708. The upper part is a buoyance chamber 706, the lower part is a reservoir 707 which is part filled with liquid (usually sea water) and part filled with gas (air or nitrogen). The housing bears at its lower end a universal joint 704 to which is attached an anchor line 703. The cylinder 709 is formed as an inner sleeve and defines an inner chamber separated from the buoyancy chamber and in which the piston runs. The inner chamber communicates directly with the lower part of the reservoir by means of large holes 710 through the cylinder 709. Cylinder 709 has a smaller diameter upper part and a larger diameter lower part joined at a transition 723.

The piston, unlike an ordinary piston, has no head but instead is machined to a high quality finish along its entire length. The piston is supported laterally by two bushes or bearings 711 and 712 at the upper end. These bearings also act as seals to prevent ingress of sea-water from the outside of the device through to the inner chamber and reservoir. The bearings are mounted in a bearing assembly 713 which can be withdrawn from the inner sleeve for replacement. Lugs 714 are provided to assist in this operation. The bearings 711 and 712 act as seals. A further seal 715 is at the top of the housing and is designed to be easily adjustable and replaceable under water. The piston bears at its top a universal joint 702 carrying a line 701, for instance to a moored vessel.

When the piston is fully down in the cylinder, member 716*a* which is mounted on the bearing carrier 713 seals against a member 716*b* on the piston. The interface between 716*a* and 716*b* incorporates further seals to minimise the chance of seepage while the piston is fully down (as will be the case most of the time). The upper part of the seal is mounted on a laminated rubber shock absorber. This is designed to take the shock load of the piston landing home in the barrel. The motion of the piston is slowed near the bottom of its stroke by the dashpot arrangement 722 at the bottom of the piston. A second shock absorbing ring 717 is located at the bottom of the piston to take the upward shock of impact against the mounting of the lower bearing 712. Again the motion of the piston is slowed by a dashpot effect as 717 passes into the narrower part of the inner sleeve above the transition 723.

A monitoring tube 724 passes the full length of the piston. An transponder 725 is connected to a pressure transducer in the monitor tube. This can be interrogated by the surface vessel to convey information on pressure, piston excursion etc.

Figure 8:
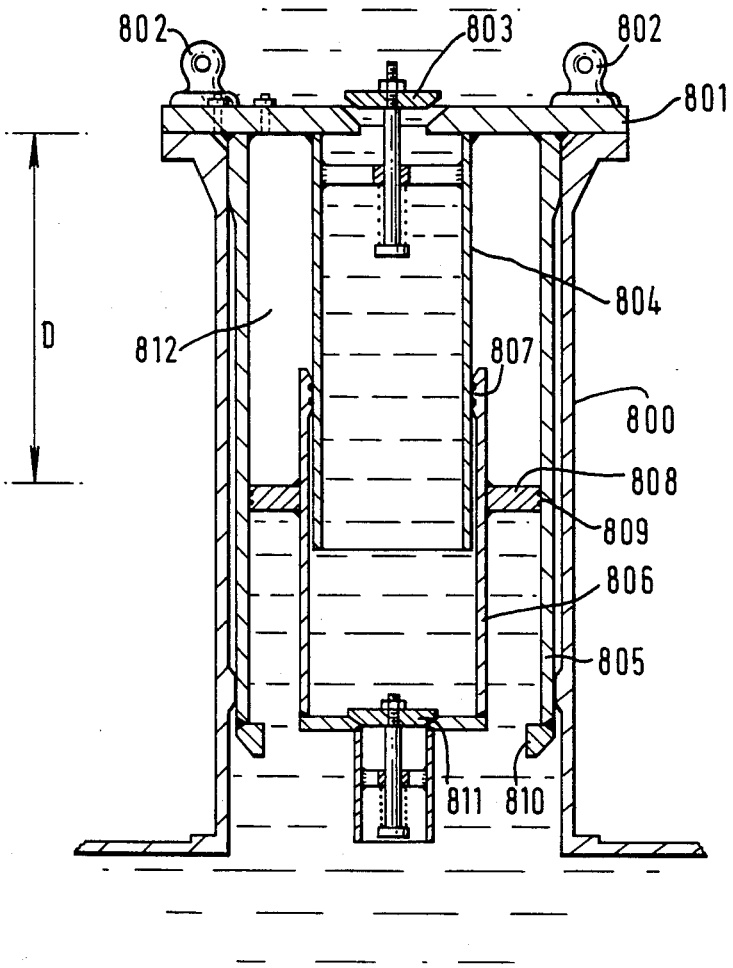
FIG. 8 is a diagrammatic longitudinal cross-section through a pump-out system incorporated in the device of FIG. 7.

On the outside of the reservoir there are three penetrations: 720 is a non-return valve, 721 contains an automatic pump out system shown in detail in FIG. 8. 726 and 727 are block valves and are closed during operation of the system. The pump out system 721 is described elsewhere herein. Its purpose is to pump out any water that may leak into the system during operation. It does not need a power supply since the motive force is the cyclic pressure changes in the reservoir. These occur with each stroke of the piston. The pump is sized so that no fluid is pumped out of the system when the system is operating at the correct precharge pressure.

Lugs are provided for installation and maintenance. 718 is for pulling the device down during installatin. 719 are trunnions for handling the device on board the installation vessel. The bearing assembly, seal assembly and pump out system all have lifting eyes. There will normally also be facilities (not shown) for jacking the piston up for maintenance on the seals.

Constructional details of a compensator shown in FIG. 7 will now be described by way of illustration:

(i) Piston

The piston (1784 mm OD and 16 mm long) is fabricated of rolled plate. The plate is clad externally with monel by explosive cladding techniques prior to rolling. The rolled plate is welded to produce cylindrical sections which are machined to a high quality of surface finish. The sections are bolted together end to end to achieve a piston of constant diameter and desired length. The complete piston when unbalasted weighs 32 tons. When installed in the cylinder, it is filled with solid ballast and water to achieve sufficient submerged weight to ensure that the mooring can operate in moderate sea conditions with the seals wholly ineffective.

(ii) Cylinder

This construction consists of rolled and formed plate. The total OD is 5000 mm and length 20 meters; plate thicknesses for a typical location are around 18 mm, the dished ends being thicker.

(iii) Bearings

Self lubricating bearings are used. Leaded bronze Merriman bearings are the most suitable. These have good wear characteristics, an adequate PV value and high tolerance to dirt. It is quite feasible with the sealing system proposed to provide oil lubrication to bearings and seals by filling the top half of the inner sleeve with oil up to the level of the main seal. The oil may be dosed with additives to enhance its oil water separating ability, and in this way leakage into the system would pass down through the oil which is of lower density than water. Leakage of water out of the system will be via the pump-out system. The presence of oil lubricant is not vital to the functioning of the system but can enhance seal life.

The operation of the pump out system referred to above will now be described, reference being made to FIG. 8.

Mounted on penetration 721 in the main housing is a cylinder 800, closed by a circular plate 801. Plate 801 bears a pair of lifting eyes 802.

Centrally disposed in plate 801 is a non-return valve 803 (NRV1) biassed shut but arranged to allow flow out of the cylinder 800 only. A tube 804 depends from plate 801 surrounding the non-return valve 803. A wider tube 805 also depends from plate 801, concentric with tube 804, and closely spaced from the interior of the cylinder 800.

A hollow piston 806 slides over tube 804. Piston 806 has an annular inward facing seal 807 engaging the outer surface of tube 804. Piston 806 bears an annular flange 808 intermediate its ends. An outward facing seal 809 on the edge of the flange 808 engages the interior of tube 805. An inwardly protruding lip 810 on the inboard end of tube 805 serves to engage the annular flange 808 to act as a stop limiting the travel of piston 806.

The inboard end of piston 806 is closed but contains a non-return valve 811 (NRV2) biassed shut but arranged to permit flow into the interior of piston 806 only.

The annular space 812 between tubes 804 and 805 bounded at the bottom by flange 808 is filled with air.

When the main piston 705 of the motion compensator is forcibly withdrawn to the extent that the pressure of the water in the reservoir falls below the air pressure in space 812 sufficiently to open NRV2 (811), pump out piston 806 will be withdrawn also. If the main seals of the piston 705 do not leak, then when the main piston returns to the fully home position, the pressure in the reservoir will return to its starting value. This will not be sufficient to depress piston 806. Accordingly, no pump action will occur.

If on the other hand the seals of piston 705 pass water into the reservoir when piston 705 is withdrawn, the pressure in the reservoir will be increased when the piston returns and may exceed the air pressure in space 812 enough to depress piston 806, thus pumping out part of the contents of the chamber defined by tube 804 and piston 806. The pumping action may be repeated on subsequent small movements of the main piston 705 to restore the original water content of the reservoir. This operation will be more clearly understood from the following consideration of a specific example.

With reference to FIG. 8, let the various operating parameters be designated as follows:

| | |
|---|---|
| Piston 806 displacement | = D |
| Pressure in reservoir | = $P_1T/m^2_{Absolute}$ |
| Pressure within piston 806 of pump | = $P_2T/m^2_{Absolute}$ |
| Pressure in air pocket 812 of pump | = $P_3T/m^2_{Absolute}$ |

-continued

External hydrostatic pressure $= P_4 T/m^2_{Absolute}$

Annular area of air pocket 812 $= A_3 = 0.50\ m^2$
Area of piston 806 (internal) $= A_2 = 0.20\ m^2$
For forces on piston to balance:
$P_1(A_2 + A_3) = P_2A_2 + P_3A_3$ $$\text{hence } P_3 = \frac{0.7P_1 - 0.2P_2}{0.5}$$

$$\text{and } P_2 = \frac{0.7P_1 - 0.5P_3}{0.2}$$

Piston 806 displacement D at pressure $P_3$ is given by $$D = D\max \frac{P_{30}}{P_3}$$

Where $P_{30}$ is the precharge value of $P_3$ applied when piston 806 is fully extended against piston stop 810.

Assume for the present purposes that $P_{30}=23\ T/m_z$ at Dmax 1.6 m.

The relationship between the various pressures and the displacement of the piston 806 are given in Table 1

TABLE 1

Relationship between pressures on piston $T/m^2$ Abs.) and Displacement D(m)

| $P_2$ | $P_1$ | $P_3$ | D | $P_1 = P_2 = P_3$ | D |
|---|---|---|---|---|---|
| 100 | 70 | 58 | .634 | 70 | .53 |
| 100 | 60 | 44 | .84 | 60 | .61 |
| 100 | 50 | 30 | 1.23 | 50 | .74 |
| 100 | 45 | 23* | 1.6* | 45 | .82 |
| 100 | 40 | 23* | 1.6* | 40 | .92 |
| 100 | 30 | 23* | 1.6* | 30 | 1.23 |
| 100 | 20 | 23* | 1.6* | 23 | 1.60* |

*Piston against end stop at D max.

Consider the device as shown in FIG. 7, moored in 160 meters of water and at a depth of 90 meters under worst survivable storm conditions:

Let:
Mean line tension $T_H=150$ tons
Significant wave height=14.0 meters
Significant dynamic motion=±5 meters
Maximum dynamic motion=±9 meters (short period)

A. When there is no leakage into the device

When the piston of the device is fully home $P_1=45\ T/m^2$ (as designed),

The largest wave will cause the piston to withdraw 8.0 meters and return to its fully home position.

At maximum stroke $P_1=22.5\ T/m^2$.

At the start of the stroke $P_1=P_2=P_3=45\ T/m^2$, and from table 1, D=0.82M.

At maximum stroke $P_1=P_2=22.5\ T/m^2$, $P_3=23\ T/m^2$ and D=D max=1.6 meters, i.e. piston 806 is fully withdrawn.

During stroke, non return valve 2 (NRV2) will be open.

While the piston 705 of the device moves in, NRV2 will be closed and NRV1 will be closed until $P_2$ rises to the external pressure of 100 $T/m^2$ Abs.

Only then will the pump piston move from its position of D max=1.6 meters and $P_3=23\ T/m^2$.

This will occur when $$P_1 = \frac{0.2P_2 + 0.5P_3}{0.7}$$

i.e. when $P_1=45\ T/m^2$

As $P_1$ never exceeds 45 $T/m^2$ (Abs) no water will be pumped out of the system.

B. Consider leakage in the system

Assume that leakage via the main piston seals of the device occurred prior to the storm, while the pretension was 25 tons and the operating depth was 50 meters. Assume that leakage was sufficient to equalize internal and external pressures at 60 $T/m^2$. The reservoir air volume of the device at 60 $T/m^2$ is 15 cu. meters. The pressure and volume should be (when there is no leakage) 45 $T/M^2$ and 20 cu. meters. In consequence $5M^3$ of water is assumed to have leaked into the system.

Under survival conditions, the mean value of $T_H=150$ T; the operating depth is 90 m and reservoir pressure will be 53 $T/M^2$ hence the piston will be withdrawn 0.8 meters mean and will oscillate about this point as the vessel responds to the waves.

There is adequate reserve in this situation since $T_H$ at full piston extension is only 7 tons less than before leakage occurred. The available oscillatory motion from mean mooring load is reduced to ±15 meters compared with the designed value of ±17 meters. The anticipated total applied motion (long period plus wave induced) is 13 meters.

Final Maximum Permissible Leakage Rate in the device

Consider a 14 meter wave and 13 sec period. The oscillatory surge motion double amplitude will be $=0.55\times14=7.7$ m (i.e. wave height multiplied by a coefficient of 0.55).

If mean piston extension =0.8 meters then the maximum value of d=4.65 m, (note piston area=2.5 $m^2$).

$$P_1 = \frac{15 \times 60}{15 + 4.65 \times 2.5}$$

$=33.8\ T/M^2$ $P_1$ will oscillate from 60 to 33.8 $T/M^2$ and back to 60 $T/M^2$ with the passage of a 14 meter wave.

With the passage of smaller waves the range will be smaller. With larger waves the range will be larger.

The mechanics of the pump operation under these circumstances may now be considered.

(i) At the start of stroke, time $t=t_o$ with the piston 705 of the device fully home, $P_1=P_2=P_3=60\ T/M^2$, D=0.61.
At time t from $t=t_o$ to $t_o+6.5$ secs.
NRV 2 will be open, $P_1=P_2=P_3$, and the pump piston 806 moves in response to change in $P_3$.

(ii) At time $t=t_o+6.5$ secs. $P_1=P_2=P_3=33.8\ T/M^2$, D=0.89 m.
At time t, from $t_o+6.5$ secs to $t_o+13$ secs.
The piston of the device is moving back in; NRV2 is closed, NRV1 is closed until $P_2$ rises to external pressure of 100 $T/M^2$ when $P_2=100\ T/M^2$. NRV 1 opens and pump piston moves and D changes.

(iii) At time $t=t_o+13$ secs. $P_1=60\ T/M^2$ $P_2=100\ T/M^2$ $$P_3 = \frac{0.7P_1 - 0.2P_2}{0.5}$$

$=44\ T/M^2$ $D=0.84$ meters.

From time $t=t_o+13$ secs to $t_o+19.5$ secs., device piston 705 is moving out and NRV 1 is closed, NRV 2 is closed until $P_2=P_1$ i.e. when $P_2=P_1=P_3=44\ T/M^2$. At this time NRV 2 opens, water is drawn into the piston of the pump from the reservoir as the air in the air pocket expands in response to falling pressures $P_1$ and $P_2$.

(iv) At time $t=t_o+19.5$ secs (second wave) $P_1=P_2=P_3=33.8\ T/M^2$, $D=1.089$ m.

(v) At time $t=t_o+26$ secs (end of second wave), $P_1=60\ T/M^2$ $P_2=100\ T/M^2$ $P_3=44\ T/M^2$, $D=0.84$ meters.

Amount of Water Pumped Out During Each Wave Cycle

The amount of water pumped out with the passage of a 14 meter wave is therefore $A_2\,(1.089-0.84)$, $=0.050\ m^3$.

In a 14 meter significant sea some waves are larger than 14 meters, some are smaller. The mean height of the largest one third of waves is 14 meters. The mean height of the remainder is probably about 9 meters.

The significant period is 13 secs.

Therefore:

Volume pumped out due to ⅓ largest waves $$= 0.050 \times \frac{3600}{3 \times 13}$$

$=4.62\ m^3$ hr.

Allowing for the fact that the relationship between the amount of water pumped out and wave height is non linear then taking into consideration the contribution of the smaller waves the approximate total is 8 cu. meters/hr.

This pump out rate is approximately equal to the flow into the system assuming a complete failure of the primary seal plus wear in both bearings of about 2 mm.

It should be noted that where a device of the type shown in FIG. 7 is employed in a mooring line for a vessel extending between the vessel and an underwater anchor, lateral motion of the vessel, e.g. is response to currents, is progressively resisted both on account of withdrawal of the piston causing a increase in pressure differential thereacross and an account of the increase in water pressure on the ambient side of the piston caused by the motion compensator moving down in the water as the vessel moves away from the anchor.

The mooring force in a given device will thus be dependant on the following separately varying parameters:

(1) inclination of the device,
(2) depth of immersion of the device,
(3) position of the piston, and
(4) piston submerged weight.

Figure 9:
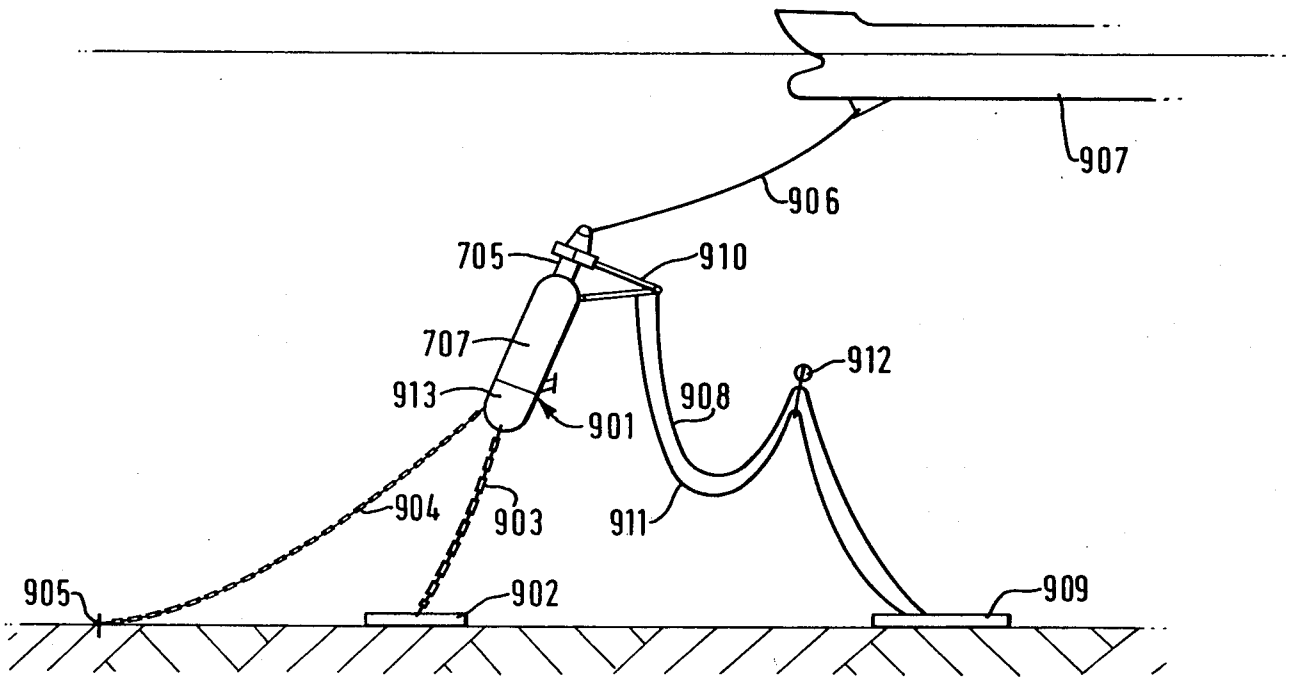
FIG. 9 is a schematic piece of an arrangement, including a device as shown in FIG. 7, for mooring a tanker by a hose used for fluid transfer.

The mooring device of the kind illustrated in FIGS. 7 and 8 may also be employed in a system for transferring fluid such as oil from an underwater location to a surface vessel. In the apparatus shown in FIG. 9 a mooring device 901 of the general type described with reference to FIGS. 7 and 8, although not necessarily having the particular dimensions previously described, is tethered to a sea floor anchor 902, such as a concrete base, by a riser chain 903, e.g. at 15 cm chain. The device however incorporates an additional ballastable reservoir below reservoir 707. A lighter catenerary chain 904 connects a lug on one side of the device 901 to an anchor 905 spaced from anchor 902 to prevent rotation of the device 901.

A hose 906, such as a 50 cm diameter 65 meter long hose, extends between suitable swivel mounted couplings on the piston 705 of the device 901 and a tanker vessel 907. The hose acts both as a tether for the tanker and as a means of transferring fluid to the tanker. The swivel coupling of the hose to the piston allows "weather vaning" of the tanker. Hose 906 is equipped with floats to render it buoyant.

A fluid supply hose 908, e.g. a 50 cm hose, connects a sea bed pipeline terminal 909 to a coupling on an elbow in an articulated connecting arm 910 linking the piston top and cylinder top of device 901. The upper part of the connecting arm 910 forms a conduit connecting house 908 to hose 906.

A hose 911 for the supply of pressurised water extends from the terminal 909 to a coupling on the lower part of articulated arm 910. The said lower part of the arm forms a conduit connecting hose 911 to the ballastable reservoir.

Both hoses 911 and 908 are suspended at about midway between the mooring device and the terminal 909 by a buoy 912.

When not in use the mooring device 901 may be sunk by pumping water from the pipeline end manifold 909 through hose 911 to flood the ballastable reservoir, thus compressing the air therein. The buoyancy of the mooring device is due to a combination of the fixed buoyancy of the upper chamber 706, the variable buoyancy of the lower reservoir 707 and the ballastable reservoir. The proportions of these may be so selected that flooding of the ballastable reservoir causes the device 901 to sink.

Release of the water pressure applied through hose 911 will result in the air trapped in reservoir 707 expanding to displace water from the reservoir to produce nett buoyancy once again.

By this arrangement, the mooring device may be sunk temporarily to avoid damage by passing vessels, floating ice or waves.

By way of example, the mooring device 901 may comprise a 250 ton total nett buoyancy spring buoy having an integral 100 ton (submerged weight) 2.36 m diameter piston with 12 meters stroke. The ballastable reservior may provide a floodable buoyancy of 400 $M^3$ capacity which can be flooded with 300 tons of water by pumping from the terminal.

When a tanker is moored by hose 906 to the mooring device 901, wave motion and environmental forces will cause the tanker to move relative to the mooring device. When such relative motion pulls up the piston, the air pressure in the reservoir will be progressively reduced so that the tension in the hose 906 will be increased gradually.

It can be arranged that the differential pressure between the reservoir and the ambient water is zero when the piston is hard down, for a given depth of immersion of the device, thus giving zero pressure across the piston seals in this condition.

The differential pressure across the piston seals also depends on the depth of the buoy as the external pressure increases with depth.

The component of the hose mooring force in line with the piston axis is equal to the piston area multiplied by the differential pressure between the water below and above the piston seal plus the component of piston submerged weight in line with the piston axis. This mooring force in a given device is thus dependent upon the following separately varying parameters:

(1) spring buoy inclination, (2) depth of immersion of spring buoy, (3) position of piston, and (4) piston submerged weight.

Under small loadings (line tensions below about 100 tons) the mooring force is resisted by piston self weight plus 'suction' induced by parameter No. 2. Hence for most seastates (up to 4.5 m significant wave height (significant wave height (Hs) is the mean height of the largest third of the waves) the piston is hard down on the bearing (fully retracted) all the time. The motion compensation (piston movement) only occurs when the force exceeds 100 tons (i.e. when Hs exceeds 4.5 meters and then only rarely). The spring stiffness is quite low at high line forces and so dynamic peak loads are reduced compared with a conventional single point mooring where stiffness progressively increases with load. Also the depth of immersion of the spring buoy is such that it is not itself subject to wave induced motion. This removes a further dynamic component of mooring force that is inherent with all systems which incorporate a surface buoy.

For this reason the maximum mooring force under 5.0 m significant sea conditions is around 130 tons.

Thus a system as described above may be designed to ensure that the mooring device can operate in up to 5.5 m significant sea conditions without failure of the weak link (tanker connection) and that stresses will not exceed 75% of yield elsewhere.

In a modification of the system just described, the mooring device may be replaced by one which comprises a buoyant cylinder tethered to the sea bottom and a heavy piston riding in the cylinder but tethering the tanker by virtue solely of the piston weight rather than by pneumatic pressure. Alternatively, this arrangement may be inverted so that a heavy cylinder rides over a buoyant piston. Such arrangements essentially constitute a telescopic riser tethered between the anchoring point and the vessel.

It will be appreciated that the invention is not restricted to the particular details described above but that numerous modifications and variations can be made without departing from the scope of the invention.

I claim:

1. An underwater motion compensator installation to accommodate relative movement between interconnected objects which are relatively movable, comprising: first telescopically acting means for coupling to a first object; and second telescopically acting means for coupling to a second object, said first and second means being located beneath a depth of water, said first and second means also for: (1) defining a variable, gas containing volume therebetween, which gas containing volume expands as said first and second means move farther apart from one another, (2) allowing telescopic movement therebetween to elongate the connection between the objects, which telescopic movement is resisted by a restoring force produced by said expansion of said gas containing volume against ambient water pressure at said depth.

2. A compensator installation as claimed in claim 1 wherein said variable, gas containing volume is provided by means defining an at least partially submerged chamber containing a gas, which chamber comprises as said first and second telescopically acting means a cylinder and a piston movable along said cylinder in sealing relationship therewith, the volume of said chamber being increased by lengthening said connection, acting to move said piston in said cylinder, the piston and cylinder being exposed to said ambient water pressure which tend to decrease said gas volume.

3. A compensator installation as claimed in claim 2, wherein said variable, gas containing volume is vented to the atmosphere.

4. A compensator installation as claimed in claim 3 wherein the piston and cylinder are arranged so as to form a telescopic mooring column extending from the water surface to the bottom thereof.

5. A compensator installation as claimed in claim 1 wherein said compensator comprises as said first and second telescopically acting means, a cylinder and a piston movable along said cylinder in sealing relationship therewith, respectively, to define a variable volume chamber containing a liquid, a reservoir containing said gas and a liquid having an interface with said gas, and means defining a flow path interconnecting the said chamber and reservoir for liquid flow therethrough in response to changes in the volume of the chamber.

6. A compensator installation as claimed in claim 1 further including a buoy carrying said telescopically acting means.

7. A compensator installation as claimed in claim 6 wherein the compensator is of variable buoyancy and comprises means for varying the buoyancy of said buoy between a first state in which the compensator is buoyant in water and a second state in which the compensator has negative buoyancy.

8. A method for providing resilience in a connection between a first object and a second object movable relative to said first object, comprising the steps of:

connecting a compensator between the first and second objects for accommodating relative movement between the objects, which compensator comprises a pair of telescopically acting members defining a variable, gas containing volume located beneath a substantial depth of water, each such member being connected to a respective one of said objects such that telescopic movement of the members to elongate the connection is resisted by a restoring force produced by expanding the volume occupied by the gas ambient water pressure at said substantial depth; and moving said objects.

9. A method as claimed in claim 8 wherein the first object is below the surface of a body of water and the second object is at or near the surface of the water.

10. A method as claimed in claim 9 wherein the object at or near the surface is connected to the compensator by a flexible conduit for the transfer of fluid.

11. A method as claimed in claim 8 wherein the compensator comprises means defining an at least substantially submerged chamber containing a gas, which chamber comprises a cylinder and a piston movable therealong in sealing relationship therewith, the volume of which chamber is increased by lengthening of said connection acting to move said piston in said cylinder, the piston being exposed to ambient pressure to tend to decrease said gas volume.

12. A method as claimed in claim 8 wherein the compensator comprises as said pair of telescopically acting members, a cylinder and a piston movable therealong in sealing relationship therewith defining a variable volume chamber containing a liquid, and further comprises a reservior containing said gas and a liquid having an interface with said gas, and means defining a flow path interconnecting the said chamber and reservoir for liquid flow therethrough in response to changes in the volume of the chamber.

13. A method as claimed in claim 8 wherein said compensator further comprises a buoy carrying said telescopically acting members.

14. A method as claimed in claim 13 wherein the buoy includes means for varying the buoyancy of said buoy between a condition in which the buoy is buoyant in water and a condition in which the buoy has negative buoyancy.

15. A motion compensator for underwater use in a mooring of a vessel to an underwater anchorage point, comprising:

first telescopically acting means for coupling to the anchorage; and second telescopically acting means for coupling to the vessel;

said first and second means are also for defining a variable, gas containing volume therebetween such that movement of said first and second means apart from one another expands said volume and is resisted by a restoring force produced by the expansion of the gas containing volume against ambient water pressure at a depth of said underwater use.

16. A motion compensator as claimed in claim 15, wherein said motion compensator is a telescopic mooring column which extends from the surface to the underwater anchorage location, said column including as said first and second telescopically acting means a piston and cylinder assembly defining a variable volume; and further comprising a gas containing chamber, located at a lower end of the compensator, and expansible against local ambient water pressure by elongation of said column.

17. A compensator as claimed in claim 15 further comprising pump out means driven by repeated telescopic movement of the telescopically acting means in alternate directions for pumping water which has leaked into said volume out of said gas containing volume.

18. A motion compensator as claimed in claim 15 further comprising a buoy carrying said telescopically acting means.

19. A motion compensator as claimed in claim 18 including means for varying the buoyancy of said buoy between a state in which the compensator is buoyant in water and a state in which the compensator has negative buoyancy.

20. A method for mooring a vessel to transfer fluid to or from the vessel, comprising the steps of:

mooring the vessel by a hose used for said fluid transfer using an underwater motion compensator which has (a) a first telescopically acting means for coupling to the anchorage; and (b) a second telescopically acting means for coupling to the vessel;

(c) wherein said first and second means are also for defining a variable, gas containing volume therebetween such that movement of said first and second means apart from one another expands said volume and is resisted by a restoring force produced by the expansion of the gas containing volume against ambient water pressure at a depth at which said compensator is underwater; and transferring fluid to or from said vessel.

* * * * *